United States Patent [19]

Sutton

[11] Patent Number: 4,723,875

[45] Date of Patent: Feb. 9, 1988

[54] DEEP WATER SUPPORT ASSEMBLY FOR A JACK-UP TYPE PLATFORM

[76] Inventor: John R. Sutton, 3775 Long Ave., Beaumont, Tex. 77706

[21] Appl. No.: 14,709

[22] Filed: Feb. 13, 1987

[51] Int. Cl.[4] ..... E02B 17/02; E02B 17/08; E02D 25/00

[52] U.S. Cl. ..... 405/204; 405/196; 405/224; 114/264

[58] Field of Search ..... 405/195-200, 405/202-210, 224, 225, 227, 222, 223; 114/264, 265; 175/5-7

[56] References Cited

U.S. PATENT DOCUMENTS

| | | | |
|---|---|---|---|
| 2,972,973 | 2/1961 | Thearle . | |
| 2,979,911 | 4/1961 | Sutton . | |
| 2,995,900 | 8/1961 | Hansucker | 405/203 |
| 3,093,972 | 6/1963 | Ward, Jr. . | |
| 3,294,051 | 12/1966 | Khelstovsky . | |
| 3,474,749 | 10/1969 | Williamson | 405/196 X |
| 3,716,994 | 2/1973 | Pogonowski . | |
| 3,797,256 | 3/1974 | Giblon . | |
| 3,982,401 | 9/1976 | Loggins | 405/200 |
| 4,052,861 | 10/1977 | Malone et al. | 405/225 X |
| 4,073,155 | 2/1978 | Schiemichen . | |
| 4,126,011 | 11/1978 | Lamy et al. | 405/196 |
| 4,169,424 | 10/1979 | Newby et al. . | |
| 4,184,790 | 1/1980 | Bassett | 405/225 |
| 4,286,898 | 9/1981 | Stafford | 405/224 |
| 4,344,721 | 8/1982 | Goldsmith . | |
| 4,468,157 | 8/1984 | Horton . | |
| 4,519,726 | 5/1985 | Knowles et al. | 405/225 X |
| 4,604,001 | 8/1986 | Wetmore . | |
| 4,610,569 | 9/1986 | Finn et al. | 405/202 |

FOREIGN PATENT DOCUMENTS

| | | | |
|---|---|---|---|
| 42540 | 12/1981 | European Pat. Off. | 405/204 |
| 2416306 | 10/1979 | France | 405/204 |
| 21614 | 2/1982 | Japan | 405/204 |
| 2034789 | 6/1980 | United Kingdom | 405/204 |

*Primary Examiner*—Nancy J. Stodola

*Attorney, Agent, or Firm*—Burns, Doane, Swecker & Mathis

[57] ABSTRACT

A deep water support assembly for a jack-up type marine structure comprises a support base, pile guides in the base through which piles are driven to anchor the support base to a marine floor, at least one receptacle containing a grouting material and adapted to mate with the jack-up structure for providing an anchoring foundation, and a support structure for supporting the receptacle at a fixed height below the marine surface. A method of assembling the marine structure is also disclosed.

14 Claims, 15 Drawing Figures

100
98
100
26
22
32
28
30
62
20
56
58
60
62
62
46
46
36
44
24
40
38
42
54
50
48
52
34

98
26
30
28
32
22
138
142
126
144
140
134
134
124
136
136
134
130
128
132

DEEP WATER SUPPORT ASSEMBLY FOR A JACK-UP TYPE PLATFORM

BACKGROUND OF THE INVENTION

The present invention relates generally to marine structures and specifically to a deep water support assembly for a jack-up type platform structure.

Conventional jack-up type marine structures are commonly used in off-shore oil drilling and production operations in water depths of between 250 to 450 feet. A typical jack-up type structure comprises a platform which serves as a barge for transporting the structure to a work site. Legs are provided at corners of the platform and are movable relative to the platform in a vertical direction.

Construction of a typical jack-up type structure is carried out on dry land. Once the structure is completed, it is floated to a work site and the legs lowered to the marine floor where they are anchored by pilings driven through pile guides in the bases of the legs and into the marine floor. Thereafter, the platform is raised above the marine surface by jacking-up the platform vertically on the legs to a desired height above the marine surface to provide an air gap of 50 to 100 feet. This jacking up of the platform is normally carried out with a jacking mechanism which operates through any known transmission arrangement connecting the legs to the platform. This construction of the typical jack-up structure permits the entire completed structure to be floated to the work site thereby reducing both the cost of building the structure and the time needed to assemble the structure at the work site.

A recent need in the field of off-shore oil drilling for marine structures usable in depths of 500 to 1700 feet of water has not been met by the jack-up type structures described. The expense of constructing a jack-up type structure which would be capable of supporting a platform in such deep waters is prohibitive in the current production market. In addition, technical problems such as providing a sufficiently wide support base which would enable the platform to be adequately supported have been difficult to combine with the jack-up platform concept.

In view of this need for deep water structures and in view of the success of the already existing jack-up technology, it can be understood that there exists a need for a structure that can be employed in deep water but which takes advantage of the time and cost benefits of known jack-up type structures. In addition, since there exists a significant number of already constructed jack-up type structures that are lying idle due to (a) economic conditions and (b) a drop in demand for platforms limited to use in water depths of between 250 and 450 feet, it is desired to find a way to extend the utility of these structures to enable their use in deeper water. This extension of utility could represent a significant savings in the cost of a complete deep water system.

SUMMARY OF THE INVENTION

The present invention answers the above-mentioned needs by providing a means for employing already constructed jack-up structures in water depths far exceeding the depths for which the structures were originally designed.

This desirable result is accomplished through the use of a support assembly for a jack-up type structure. In one embodiment of the invention, the support assembly is a tower assembly which comprises a support base, means for anchoring the support base to the marine floor, receptacle means containing grouting material and adapted to mate with the jack-up structure for providing an anchoring foundation, and receptacle support means for supporting the receptacle means at a fixed height below the marine surface.

The tower assembly is constructed while on land and in a vertical orientation and the support base is designed to serve as a barge for floating the tower assembly to a work site while it is maintained in the vertically upright position. The assembly can be partially submerged during its transportation to the work site so as to stabilize the assembly during travel.

When the assembly is roughly over the work site, controlled flooding of the assembly causes it to sink to the marine floor. As the assembly sinks, and once it has reached the marine floor it is precisely positioned over the work site. The assembly is then anchored to the marine floor by pilings which are driven through pile guides in the support base.

Once the tower assembly is in place, a jack-up type structure floated to the site is positioned over the assembly and the legs of the structure are lowered into holes in the receptacle means. Grouting material is poured into the holes around the legs of the jack-up structure so that the structure is securely anchored on the support assembly.

Additional gripping means such as pneumatic gripper rings can be employed between the jack-up legs and the walls of the receptacle holes to provide further anchoring of the jack-up structure on the support assembly.

Also, although the specific support tower construction can take any of several forms, there are advantages to employing a support tower having vertical tube columns extending between each receptacle and the support base such as providing adequate vertical rigidity to the receptacles and supporting the heavy loads experienced by jack-up type rig structures.

Removable piles can be used to anchor the support assembly to the marine floor so that the assembly can be removed after a job is complete to be moved to a new site. This reusability increases the value of each assembly by extending its potential useful life.

In an alternative embodiment of the invention, a tension leg support assembly is provided in place of the tower assembly discussed above. The tension leg assembly also comprises a support base structure, means for anchoring the support base structure to the marine floor, and receptacle means containing a grouting material and adapted to mate with the jack-up structure for providing an anchoring foundation. However, the receptacle means is provided with ballasting and deballasting chambers which permit the receptacle means to be employed as a tension leg platform which can be supported from the base structure by tension cables acting in opposition to the buoyancy forces created by deballasting the platform once the cables have been secured to the ballasted receptacle means during assembly.

Anchoring cables can also be employed to prevent sway and yaw of the support assembly to ensure that the platform elevated above the marine surface is stable.

The receptacle means advantageously includes the ballasting and deballasting means to permit the receptacles to be controllably sunk to a position where the cables can be attached thereto and then controllably deballasted to create tension in the cables. This permits the cables to both support and stabilize the receptacles and permits the buoyancy force of the body to support the jack-up type structure.

It can be understood that by employing the present invention, already existing conventional jack-up type structures can be used in very deep water. For example, by employing a support assembly with a 350 foot top level and a jack-up assembly designed for use in 150 foot water, a marine structure can be constructed which is usable in a water depth of 500 feet. Similarly, an extreme application of the present invention includes a 1400 feet support assembly. A jack-up assembly designed for use in a 300 foot depth field is anchored on top of the support assembly in a 1700 foot depth field. This two part construction results in a reduced construction cost of the deep water structure and also reduces the amount of time necessary for its assembly. In addition, because a separate support structure is provided having its own broad base, the previously prohibitive technological problem discussed above relating to adapting jack-up technology to deep water applications does not arise.

BRIEF DESCRIPTION OF THE DRAWINGS

The many advantages and objects achieved by the invention can be seen and understood through consideration of a preferred embodiments of the invention which are discussed in the following detailed description which should be considered in connection with the figures in the accompanying drawing wherein like reference numerals are applied to like elements and wherein.

DETAILED DESCRIPTION OF THE PREFERRED EMBODIMENT

Figure 1:
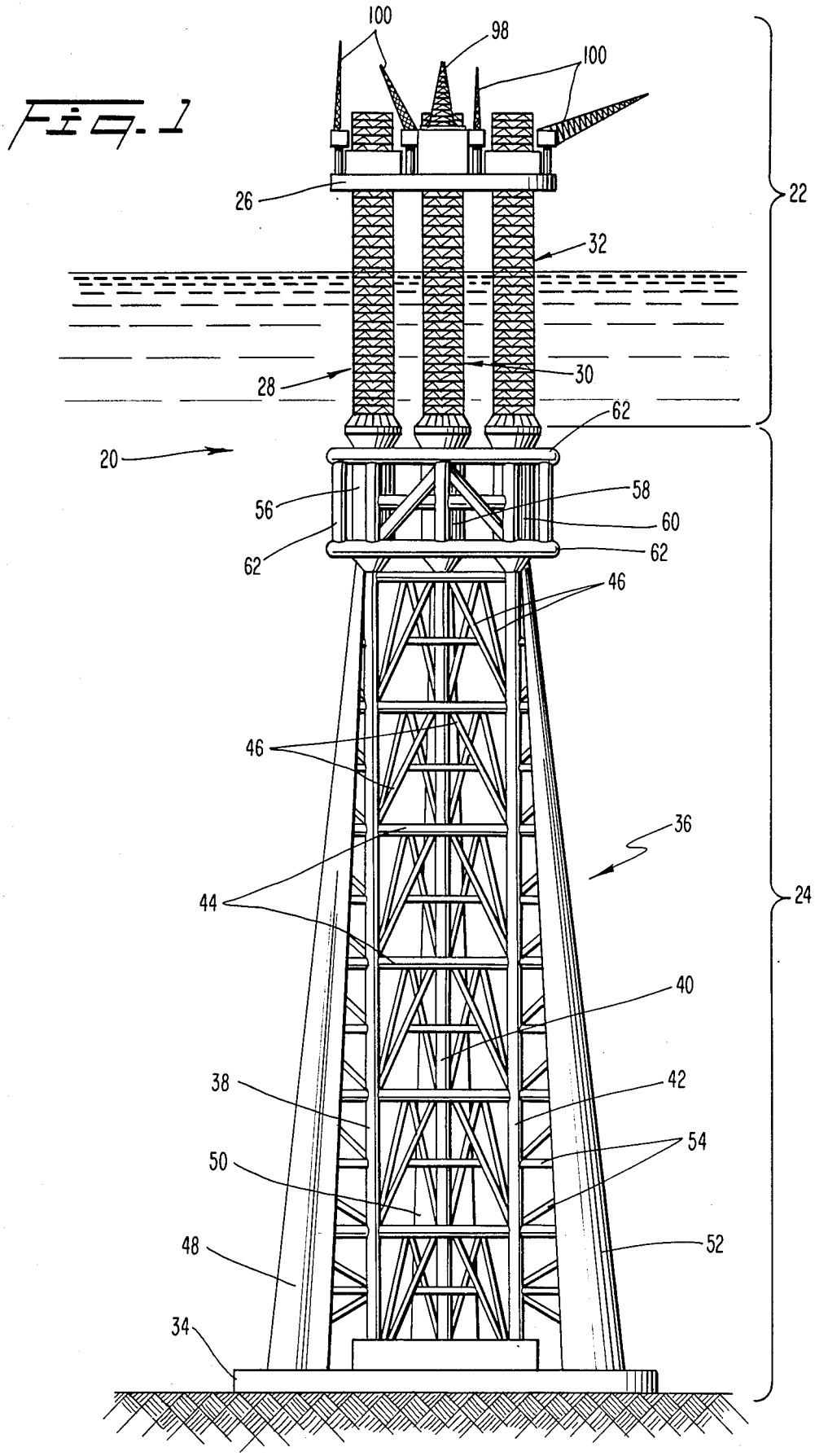
FIG. 1 is a side elevational view of a jack-up type structure anchored to a support assembly constructed in accordance with a first embodiment of the invention.

An assembled marine structure 20 in accordance with a first embodiment of the invention is shown in FIG. 1. The structure 20 includes a platform assembly 22 and a deep water support assembly 24.

The platform assembly 22 shown is a jack-up type platform assembly and includes a platform 26 which is supported on three vertically adjustable support legs 28, 30, 32. It is noted that any of several known types of platform assemblies can be employed in the present invention such as four legged rigs or caisson legged structures. Each support assembly can be designed for the specific type of platform assembly being employed in order to permit a variety of types of existing rigs to be utilized in deep water operations.

Figure 2:
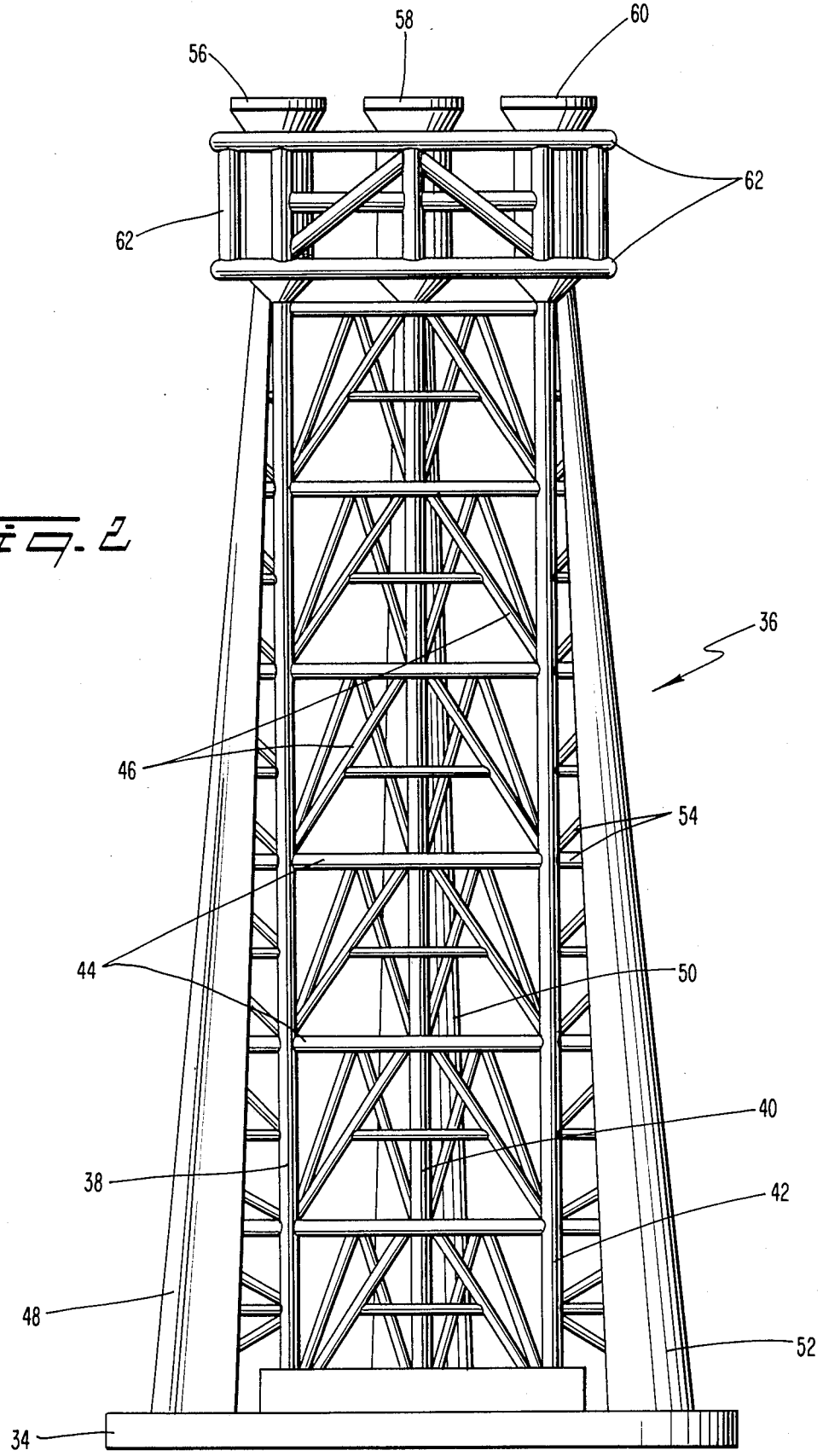
FIG. 2 is a side elevational view of the tower assembly of FIG. 1.

The support assembly 24, which is also shown apart from the platform assembly in FIG. 2, is a tower assembly comprising a support base 34 and a support frame 36 including vertical large diameter tube columns 38, 40, 42 which are connected together by braces 44, 46, and corner columns 48, 50, 52 which are connected to the vertical tube columns 38, 40, 42 by further braces 54.

Three receptacles 56, 58, 60 are positioned at the upper end of the tower assembly 24 opposite the support base 34. The receptacles are each positioned at the top of one of the vertical columns 38, 40, 42 of the support assembly 24. A large diameter tube frame 62 connects the receptacles 56, 58, 60 and each receptacle is positioned to cooperate with a single support leg of the platform assembly 22.

Figure 3:
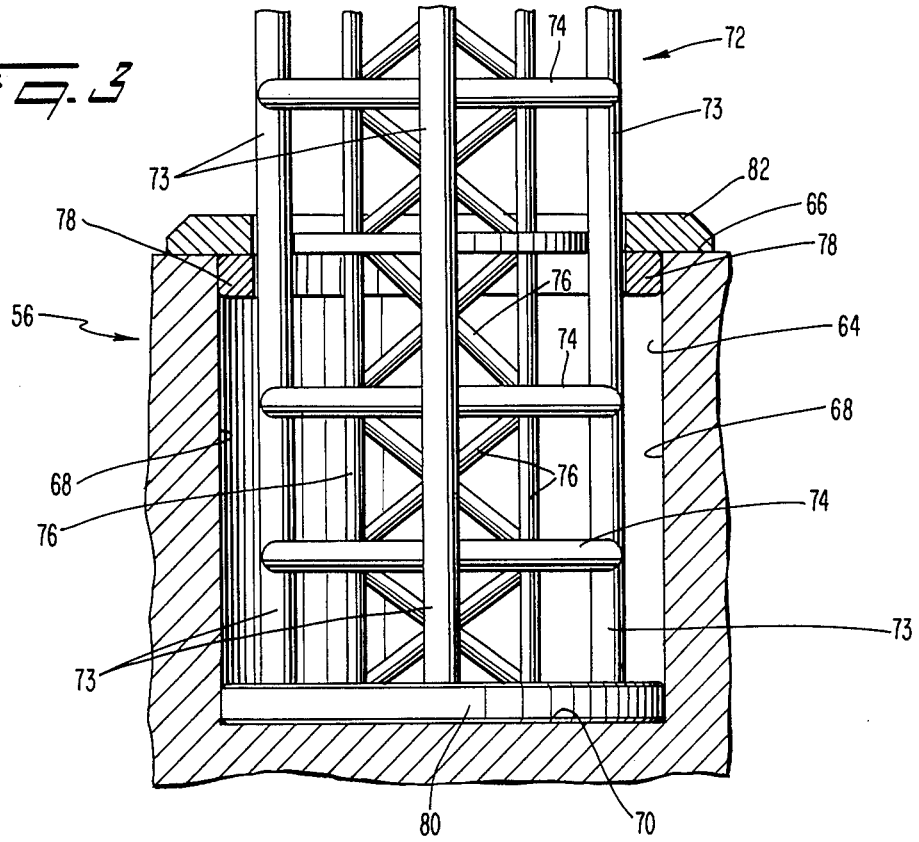
FIG. 3 is a side sectional view of a receptacle of a support assembly showing one type of jack-up type leg anchored to the support assembly.
Figure 5:
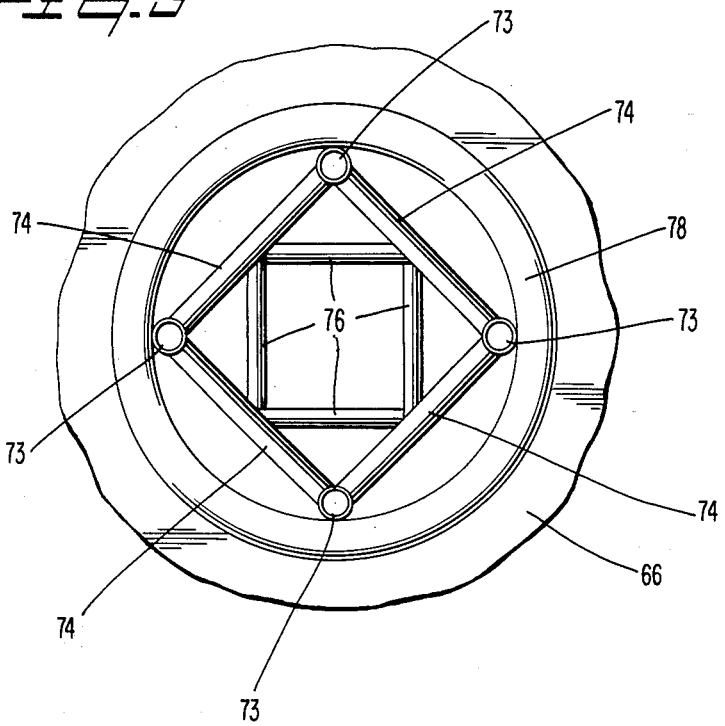
FIG. 5 is a top view of a single receptacle.

A single receptacle 56 is illustrated in FIG. 3 with a first type of support leg anchored thereto. The receptacle 56 includes a receptacle hole extending into the receptacle from a top surface 66. An inside wall surface 68 and bottom surface 70 define the hole and are constructed to contain a jack-up leg, e.g. 28 and securing elements used to anchor the leg in the receptacle hole. The jack-up leg which is anchored in the receptacle is a multiple chord leg 72 having chords 73, horizontal bracing members 74 and cross-bracing members 76. During assembly, the leg is lowered into the receptacle hole and pneumatic gripper rings 78, 80 are positioned in the space between the leg chords 73 and the inside wall surface 68. The gripper rings 78, 80 are pressurized so as to fill the gap between the chords 73 and the inside wall surface 68 as shown in FIG. 5 so as to hug the leg 72 and hold it in place in the receptacle hole. A grouting material 64, FIG. 3, such as mud or clay is then pumped into the hole and fills all free space in the hole in such a way that the leg 72 is securely anchored in the hole. A collar 82 can be attached to the top surface 66 of the receptacle around the leg structure to prevent the undesired removal of the grouting material 64 during the life of the marine structure 20.

Figure 4:
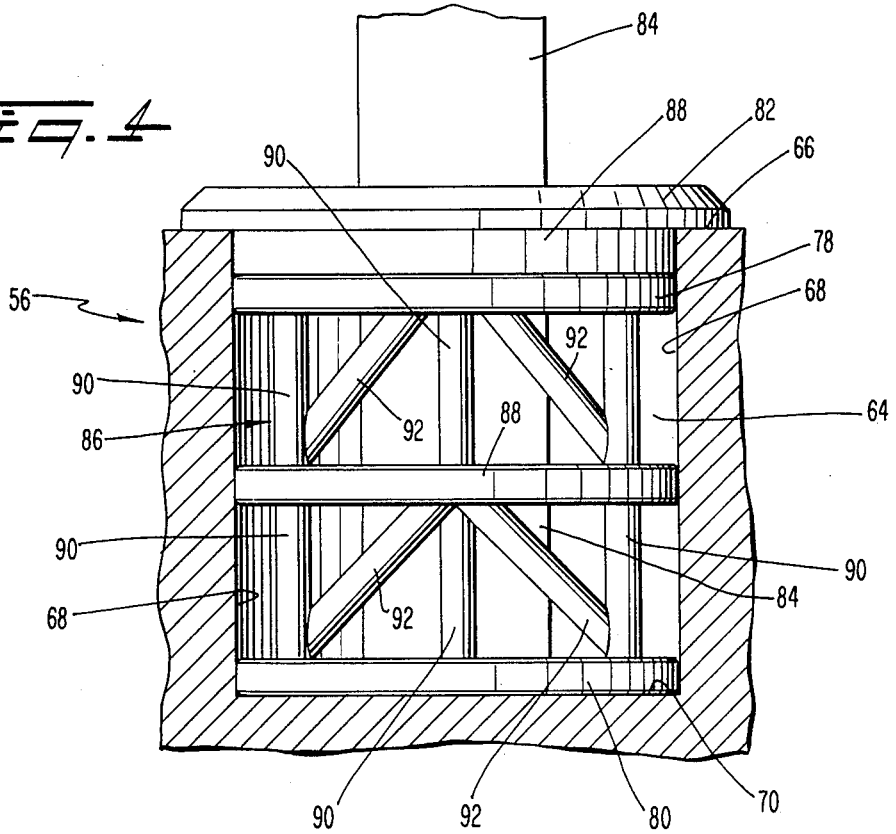
FIG. 4 is a side sectional view of a receptacle of a support assembly showing a second type of jack-up type leg anchored to the support assembly.

A caisson type leg 80 can also be anchored in the receptacle 68 and is shown in FIG. 4. A special adapter frame 86 having horizontal elements 88, vertical elements 90, and cross elements 92 is secured to the leg 84 to enable anchoring of the leg 84 in the receptacle 56. The leg 84 and frame 86 are positioned in the receptacle hole and are anchored by pneumatic grippers 78, 80 and grouting material 64 in a manner similar to that employed with the multiple chord leg 72. It is again emphasized that any type of leg structure can be securely anchored in the receptacles through the use of pneumatic grippers and grouting material as discussed above. It may be necessary to construct an adapter to enable a secure fit between the leg and the surfaces of the receptacle hole. However, no special jack-up assembly is required.

This advantageous utilization of already constructed platform assemblies in a larger marine structure permits the use of inexpensive preexisting jack-up platforms at deep water work sites and requires little or no modification of the platform assembly. This adaptation of the use of such platforms, in turn, results in cost and time savings in the production of the deep water platform structures.

Figure 6:
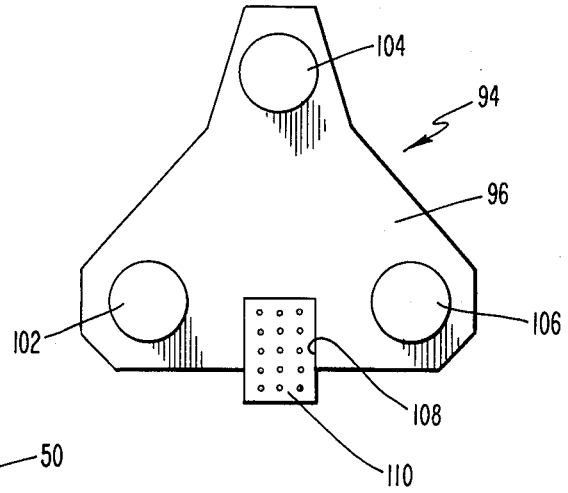
FIG. 6 is a top plan view of a jack-up type structure platform.

An area plan of a conventional platform deck is shown in FIG. 6. The deck 94 includes a work surface 96 on which equipment such as a derrick 98 and rig cranes 100 (FIG. 1) may be supported and openings 102, 104, 106 through which the support legs 28, 30, 32 extend. A gap 108 is provided between two corners of the deck 94 and rails can be provided along the sides of the gap 108 to support an additional deck over a conductor template located on the support assembly 24 and positioned beneath the gap 108.

Figure 7:
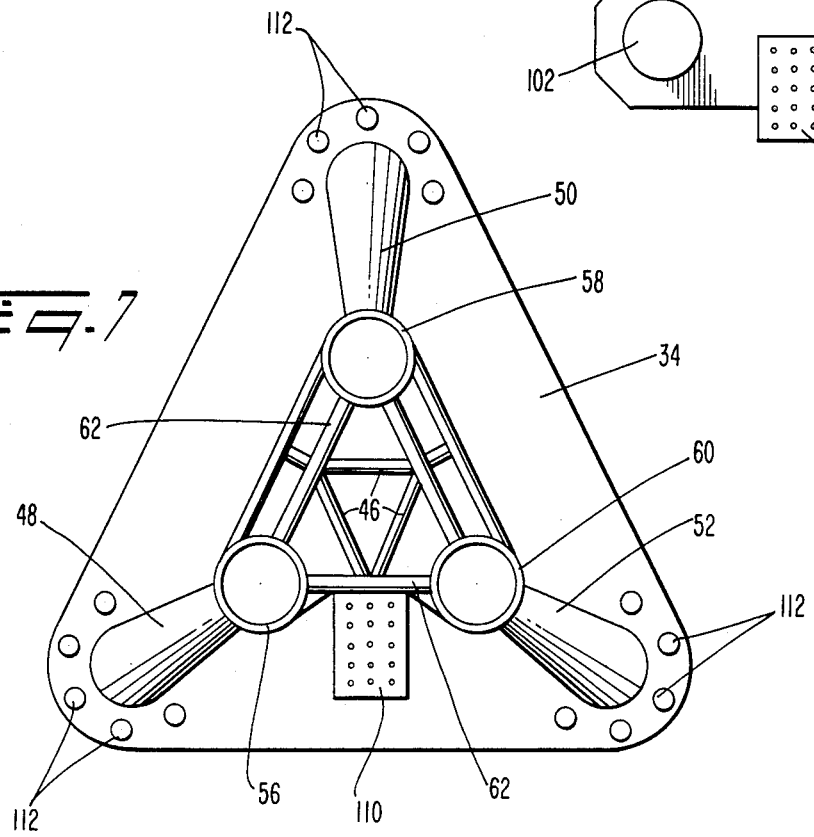
FIG. 7 is a top plan view of a tower assembly as shown in FIG. 2.

As is illustrated in FIG. 7, the tower assembly 24 has the same number of corners as the platform assembly 22. A vertical column extends from the support base 34 to each of the receptacles 56, 58, 60 and these columns are connected together by braces 44, 46.

The additional frame 62 holds the receptacles 56, 58, 60 in position on top of the vertical columns 38, 40, 42 and a conductor template 110 is mounted to the additional frame 62 between two of the tower assembly corners.

In order to provide stable lateral support of the platform 26 above the marine surface, three corner columns 48, 50, 52 are provided each of which extends outwardly from the vertical columns 38, 40, 42 towards the marine floor. Each corner column 48, 50, 52 is connected at its top end to a corresponding one of the receptacles 56, 58, 60 and is connected to the support base 34 at its lower end. The support base 34 has pile guides 112 formed at the corners of the base around the periphery of the corner columns 48, 50, 52 through which piles (not shown) are driven to anchor the support assembly 24 to the marine floor.

The preferred method of constructing, transporting, and anchoring the support assembly 24 and of anchoring the platform assembly 22 on the support assembly will now be described with reference to FIGS. 8–11.

Figure 8:
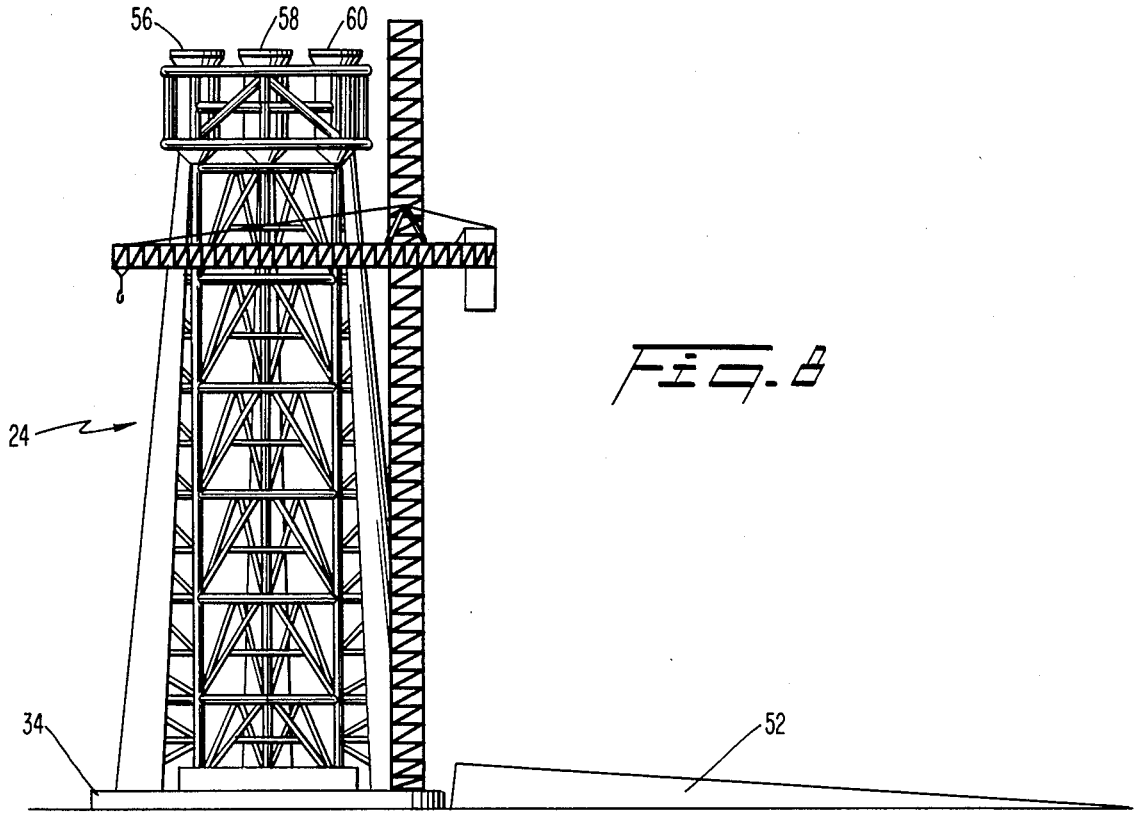
FIG. 8 is a side elevational view of a tower assembly under construction.

As shown in FIG. 8, the tower assembly 24 is constructed in a vertical position while on land. The corner columns 48, 50, 52 are constructed in a horizontal position and then raised to a vertical position and connected to the base 34, the receptacles 56, 58, 60, and the vertical columns 38, 40, 42.

Once complete, the tower assembly 24 is put to sea. The support base 34 serves as a barge and supports the assembly in an upright position in the water. Tugs 116, 118, are used to move the assembly 24 from its docking area to a desired work site.

Figure 9:
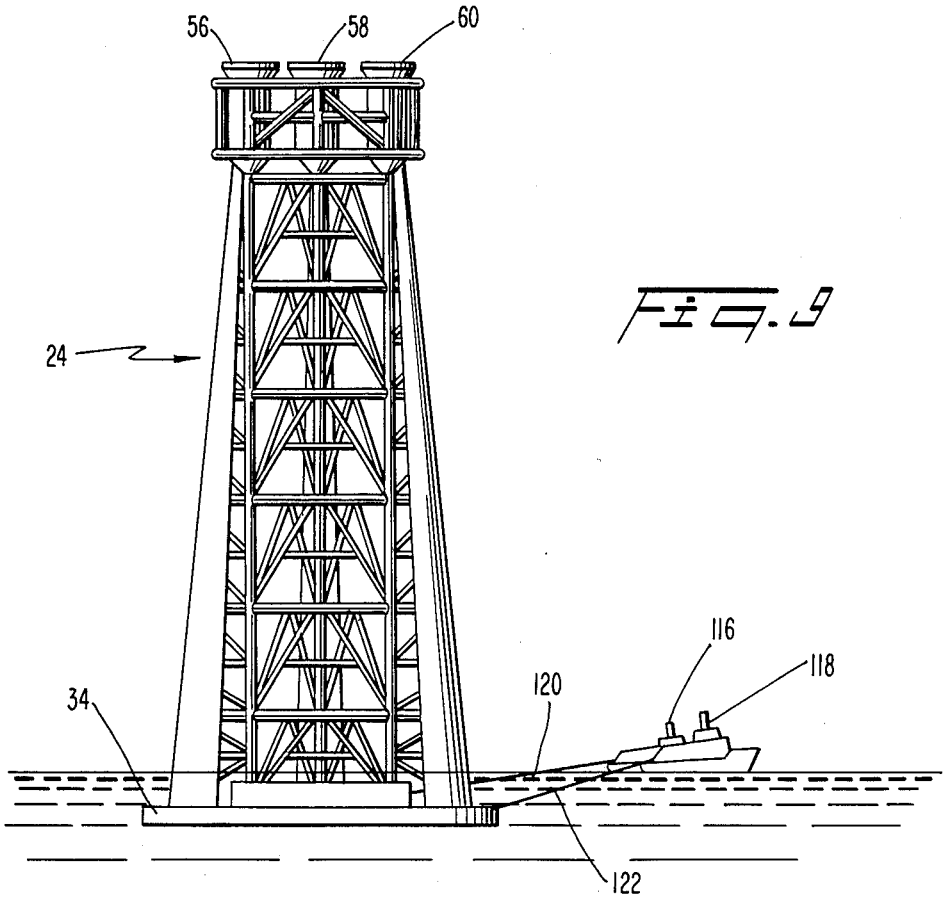
FIG. 9 is a side elevational view of a tower assembly being transported through shallow water.

The assembly 24 is shown in FIG. 9 being towed through shallow water. The support base 34 provides sufficient buoyancy to the assembly to enable the assembly to travel through shallow water such as is common in docking areas where such assemblies are constructed.

Figure 10:
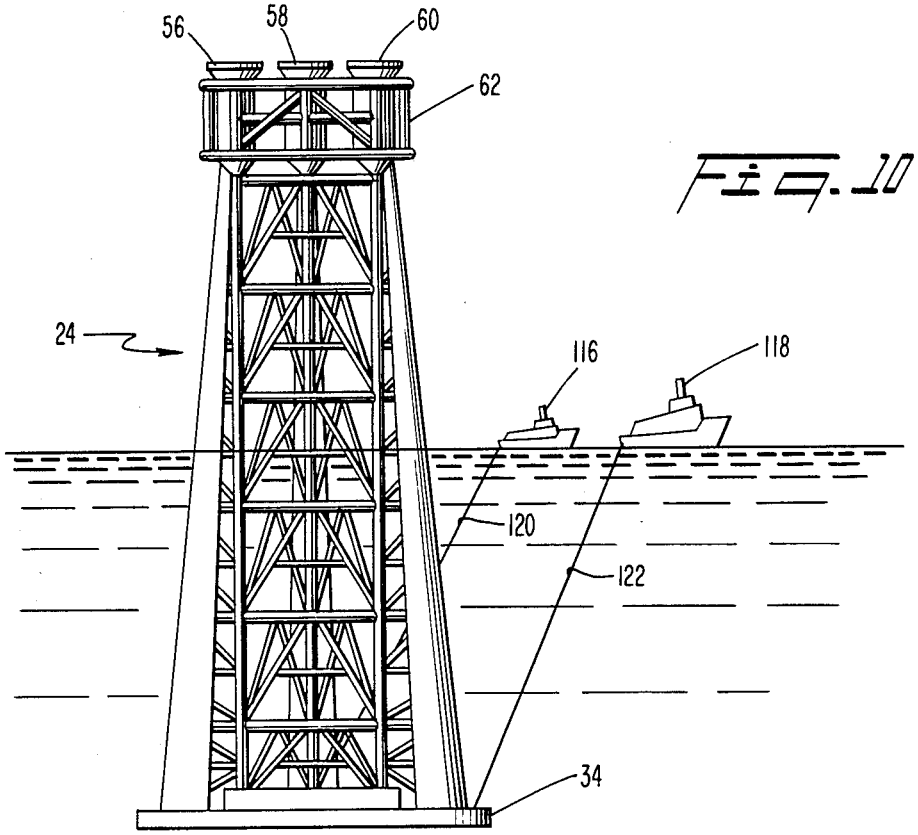
FIG. 10 is a side elevational view of a tower assembly being transported through deep water.

When the assembly 24 has been towed to deeper water, the support base 34 and the lower portions of the vertical columns 38, 40, 42 can be controllably flooded so that the assembly travels lower in the water as shown in FIG. 10. This lower position of the assembly is more stable than the position shown in FIG. 9 and protects the assembly from severe weather and waves which are common during storms in areas such as the Gulf of Mexico and the North Sea.

Once the assembly 24 has been towed to the work site, the unflooded space in the assembly is controllably flooded and the assembly slowly sinks to the marine floor. Positioning of the assembly is carried out both while the assembly is being flooded and after the assembly has reached the marine floor by the tug boats 116, 118 which control the motion of the assembly with the lines 120, 122 connecting the boats to the assembly.

Figure 11:
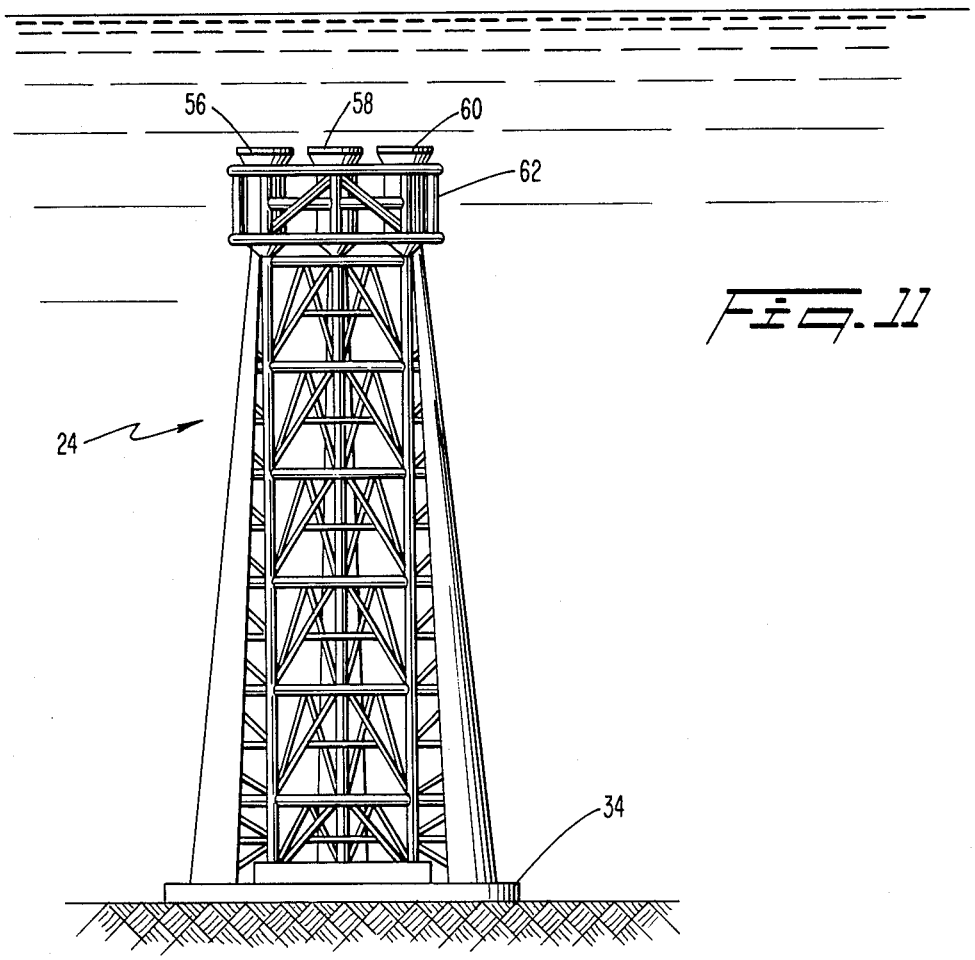
FIG. 11 is a side elevational view of a tower assembly which is in position on a marine floor at a work site.

The assembly 24 is shown in position at the work site in FIG. 11. Piles are driven through the pile guides 112 in the support base 34 once the assembly 24 is in this desired position to anchor the assembly in place on the marine floor. Releasable piles are preferably used so as to enable the assembly to be unanchored, unflooded and moved to another work site once the job at the present work site is completed. A significant savings results from being able to reuse the support assembly a second and third time since an average job takes much less time to complete than the estimated lifetime of such an assembly.

A platform assembly 22 is floated to the work site once the support assembly 24 is anchored and the support legs 28, 30, 32 of the platform assembly are lowered to a height just above the tops of the receptacles 56, 58, 60. The platform assembly 22 is then positioned in the water to provide each support leg over a mating receptacle and the legs are lowered into the receptacle holes and accurately positioned. The pneumatic grippers 78, 80, FIG. 3, are then pressurized to hold the legs 28, 30, 32 in the holes and grouting material 64 is pumped into the holes to fill the space surrounding the legs. The use of grouting material such as mud permits the later removal of the platform assembly from the receptacles 56, 58, 60 since the grouting material 64 can be removed from the holes and the pneumatic grippers 78, 80 can be depressurized thus freeing the legs 28, 30, 32 and allowing the platform assembly 32 to be moved to another work site for subsequent use.

Figure 12:
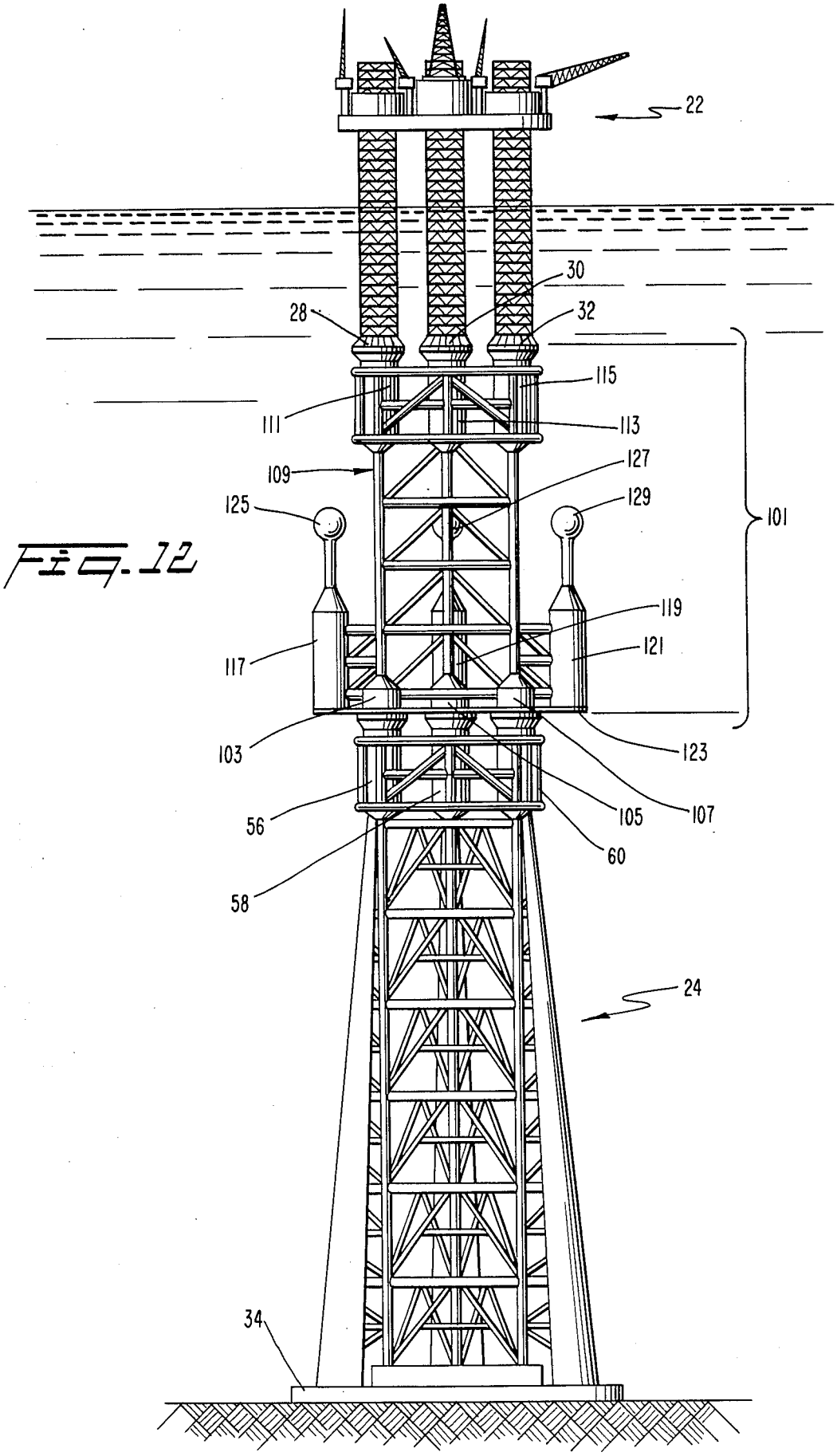
FIG. 12 is a side elevational view of a tower assembly having a base section and a midsection supporting a jack-up type structure.

Modifications of the support assembly exist that would enable the support assembly 24 to be employed in water depths of over 3000 feet. For example, as illustrated in FIG. 12, an intermediate support structure 101 may be floated to a work site in a vertical upright orientation and then lowered and anchored on the support assembly 24 so as to provide additional height to the assembly to permit the assembly's use in deeper waters than could ordinarily be possible without the use of such midsection.

The intermediate support structure, or midsection support structure 101 includes support legs 103, 105, 107 similar to the support legs 28, 30, 32 of the jack-up type platform assembly, and is anchored to the support assembly 24 in the same manner as discussed above with respect to the platform assembly 22.

A frame 109 extends between the support legs 103, 105, 107 and a plurality of receptacles 111, 113, 115 positioned at the top of the midsection support structure 101. This frame 109 supports the receptacles 111, 113, 115 at a fixed height above the receptacles 56, 58, 60 of the support assembly.

The receptacles 111, 113, 115 of the midsection support structure 101 are similar to the receptacles 56, 58, 60 of the support assembly 24 and serve to anchor the platform assembly support legs 28, 30, 32 in the same manner as described above with respect to the receptacles 56, 58, 60.

Three outer buoyancy tanks 117, 119, 121 are positioned adjacent the support legs 103, 105, 107 of the midsection structure on a base 123 of the structure 101. These tanks 117, 119, 121 along with marine salvage balloons 125, 127, 129 assist in lowering and positioning the midsection structure 101 to anchor the structure on the support assembly 24.

The use of a plurality of sections in the support assembly provides a marine structure designer with tremendous flexibility in choosing the type, size and number of support structures to employ for any given situation and for any given water depth.

Figure 13:
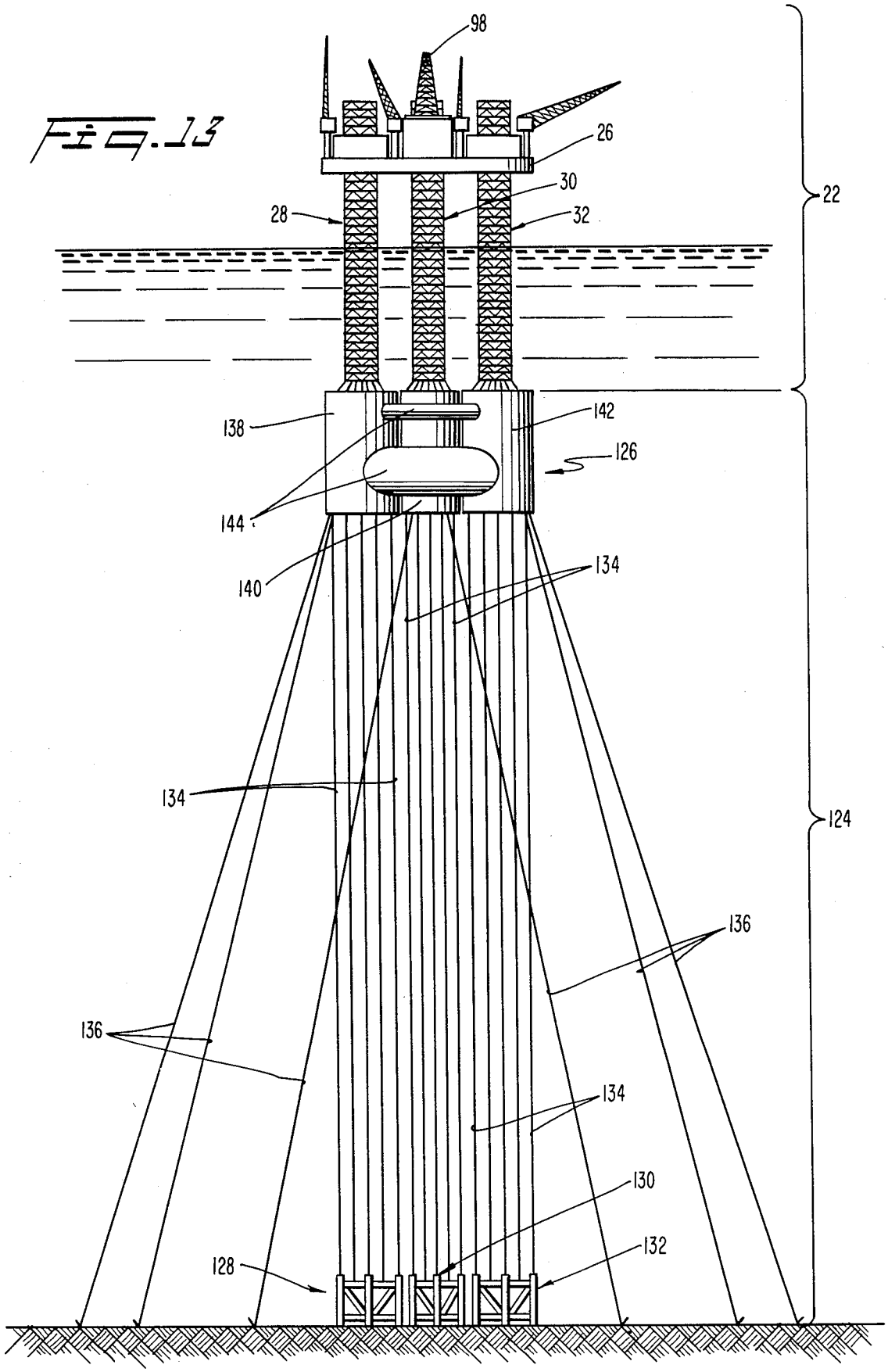
FIG. 13 is a side elevational view of a jack-up type structure anchored to a support assembly constructed according to a second embodiment of the invention.
Figure 14:
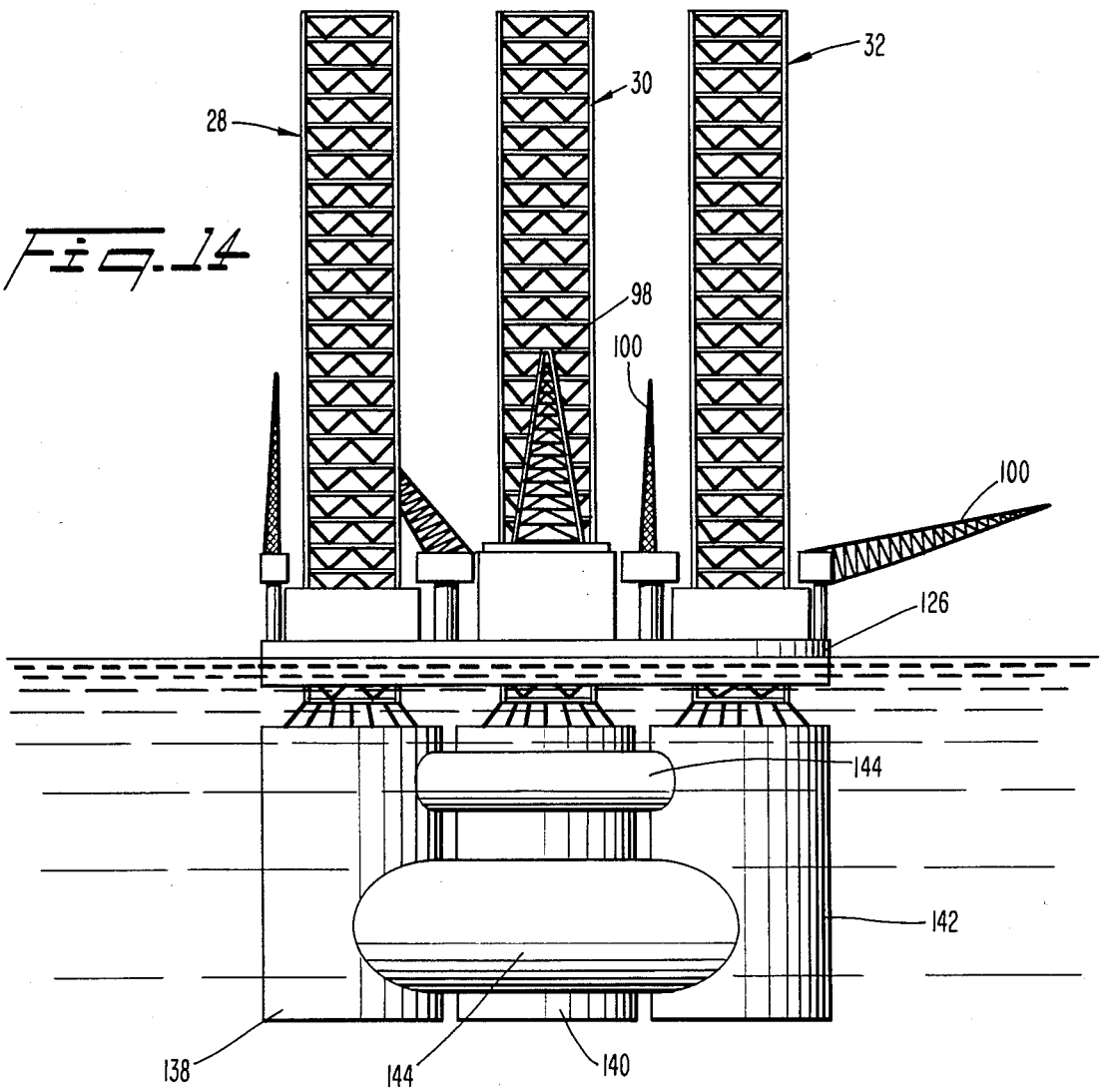
FIG. 14 is a side elevational view of the tension leg support assembly and jack-up type structure during transport to a work site.
Figure 15:
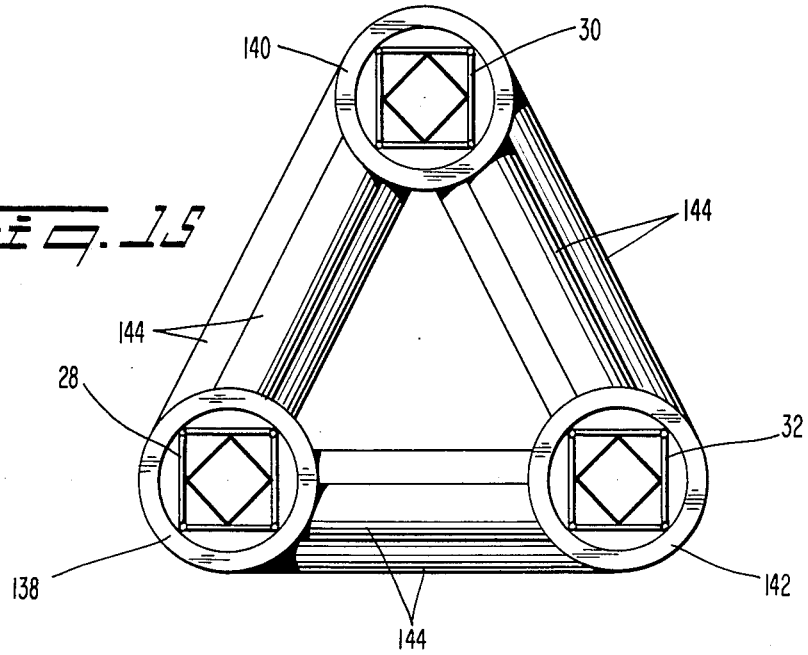
FIG. 15 is a top view of the receptacle structure of a tension leg support assembly.

A second embodiment of the present invention is shown in FIGS. 13–15. As generally illustrated in FIG. 13, in this embodiment, the support assembly is a tension leg support assembly 124 comprising a receptacle body 126, a plurality of support bases 128, 130, 132 and tension cables 134 connecting the receptacle body 126 to the support bases 128, 130, 132. Anchoring lines 136 can also be employed to add stability against excessive sway or yaw of the receptacle body 126 which can be caused by harsh sea conditions.

The receptacle body 126 is shown in FIG. 15 and includes three receptacles 138, 140, 142 connected together by a large tube frame 144 having ballast tanks (not shown) built therein so as to enable controlled ballasting and deballasting of the body 126 during assembly and use of the structure. Additional ballast compartments can be constructed in the receptacles themselves beneath the receptacle holes to enable greater buoyancy forces to be generated during deballasting of the receptacle body 126.

The receptacles 138, 140, 142 are identical to the receptacles 56, 58, 60 of the first embodiment as shown, e.g. in FIG. 3, and are utilized in the manner described above with regard to the first embodiment of the invention.

The support bases 128, 130, 132 can consist of separate frame structures as shown or may be a single larger frame structure. The three frame structures 128, 130, 132 shown in FIG. 13 include pile guides through which piles are driven to secure the frame structures to the marine floor at a desired work site. Cable attachments are also provided on the support bases to which the tension cables 134 are connected.

Construction of the tension leg support assembly 124 begins on dry land where the receptacle body 126 and support bases 128, 130, 132 are constructed. The support bases 128, 130, 132 are then transported to a work site, positioned on the marine floor, and anchored by piles to secure the bases against the anticipated forces to be exerted by the tension leg assembly.

The receptacle body 126 is moved to shallow water where a jack-up platform assembly 22 can be easily mounted thereon. Again, the anchoring of the legs 28, 30, 32 of the platform assembly 22 is carried out in the manner already discussed above. Thereafter, the platform assembly and receptacle body are transported to the work site as shown in FIG. 14 with the platform assembly already connected with the receptacle body.

Controlled ballasting of the receptacle body 126 is carried out at the work site to position the receptacle body at a height above the support bases 128, 130, 132 which enables easy attachment of the tension cables 134 between the bases and the receptacle body 126. The cables 134 are connected and the body 126 is deballasted to generate buoyancy force in the body which creates tension in the cables 134 and which supplies the necessary upward force to support the platform 26 above the marine surface when the platform is jacked up on the legs 28, 30, 32.

It should be understood that although no template is shown in the second embodiment of the invention that one could be easily employed. Each receptacle body can be individually designed for its intended use and can include any necessary drilling expedients known in the art.

It is, of course, possible to embody the invention in other specific forms than those of the preferred embodiments described above. This may be done without departing from the essence of the invention. The preferred embodiments are merely illustrative and should not be considered restrictive in any way. The scope of the invention is defined by the appended claims rather than the preceding description and all variations, substitutions, and equivalents which fall within the spirit and scope of the claims are intended to be embraced therein.

What is claimed is:

1. A marine structure comprising:

a jack-up type platform assembly having a platform and at least three support legs, each leg having a generally cylindrical adapter at the end thereof;

a support assembly including a receptacle for each support leg and first anchoring means for anchoring said receptacle at a fixed height below a marine surface, said receptacle mating with said support leg adapter and supporting said platform assembly enabling said platform to be jacked above the marine surface; and second anchoring means for anchoring said support leg in said receptacle, said second anchoring means including an axially spaced pair of inflatable rings engaging the adapter and the receptacle and grouting material placed at least between said support leg adapter and said receptacle to hold said leg in place in said receptacle.

2. The marine structure according to claim 1, wherein said first anchoring means includes a support frame between said receptacle and the marine floor, said support frame having a plurality of vertical tube columns extending between a base of said support assembly and said receptacle.

3. The marine structure according to claim 2, wherein said support frame further includes a plurality of corner columns and a support base, each of said corner columns being connected to said receptacle at a point adjacent one of said vertical columns and extending between said support base and said receptacle, each of said corner columns and said vertical columns including a longitudinal axis, the longitudinal axis of each corner column forming an angle with the longitudinal axis of the vertical column extending adjacent thereto.

4. The marine structure according to claim 1, wherein said receptacle is a cup-shaped receptacle having a hollow interior in which said support leg and said grouting material are received.

5. The marine structure according to claim 4, wherein said first anchoring means includes a support frame between said receptacle and the marine floor, said support frame having at least one vertical tube column extending between a support base and said receptacle.

6. The marine structure according to claim 1, further comprising a plurality of said receptacles, each being cup-shaped and having a hollow interior in which said support legs and said grouting material are received, and a receptacle frame extending between said receptacles and supporting said receptacles relative to each other.

7. The marine structure according to claim 1, wherein said first anchoring means includes a plurality of detachable piles.

8. The marine structure according to claim 1, further comprising:

an intermediate support structure having at least one midsection receptacle;

at least one midsection support leg supporting said midsection receptacle, said midsection support leg being anchored in said support assembly receptacle by said second anchoring means; and third anchoring means for anchoring said at least one support leg of said jack-up type platform assembly in said midsection receptacle, said third anchoring means including a grouting material placed between said support leg and said receptacle to hold said leg in place in said midsection receptacle.

9. The marine structure according to claim 8, wherein said third anchoring means further includes gripping means to provide additional anchoring of said support leg in said midsection receptacle.

10. The marine structure according to claim 8, wherein said midsection receptacle is a cup-shaped receptacle having a hollow interior in which grouting material and said support leg are received.

11. The marine structure according to claim 1, wherein said each said receptacle has an inside wall, wherein each support leg end has a piston-shape, and wherein said second anchoring means includes pneumatic rings at the top and at the bottom of piston-shaped support leg ends to forcefully grip said receptacle inside wall.

12. A method of assembling a two-part marine structure at a work site comprising the steps of:

floating a support assembly to the work site, lowering the support assembly to a fixed height beneath the marine surface by controllably flooding the support assembly, anchoring the support assembly to the marine floor, floating a jack-up platform assembly to the work site, positioning the jack-up platform assembly over the support assembly so that support legs of the jack-up platform assembly are aligned with receptacles of the support assembly, lowering support legs of the jack-up platform assembly so that they are received in the receptacles of the support assembly, pneumatically gripping the base of each support leg in a corresponding receptacle;

placing grouting material in the receptacles around the bases of the support legs to anchor and cushion the support legs in the receptacles, and elevating a platform of the jack-up platform assembly to create an air gap between the platform and the marine surface.

13. A method of assembling a two-part marine structure at a work site comprising the steps of:

positioning a jack-up platform assembly over a support assembly so that support legs of the jack-up platform assembly are aligned with receptacles of the support assembly, lowering the support legs of the jack-up platform assembly so that they are received in the receptacles of the support assembly, floating the support assembly and platform assembly together to a work site in an upright posture, lowering the support assembly and the support legs to a fixed height beneath the marine surface suitable for diving operations, anchoring the marine support assembly to the marine floor, and pneumatically gripping the base of each support leg in a corresponding receptacle, placing grouting material in the receptacles around the bases of the support legs to anchor the support legs in the receptacles, elevating a platform of the jack-up platform assembly to create an air gap between the platform and the marine surface.

14. The method according to claim 13, further comprising the step of deballasting said support assembly after anchoring said structure for dismantling and removal to a secondary location.

* * * * *